US007632159B2

(12) United States Patent
Nelson

(10) Patent No.: US 7,632,159 B2
(45) Date of Patent: Dec. 15, 2009

(54) ELECTRICAL CONNECTOR

(75) Inventor: Russel J. Nelson, Crystal Lake, IL (US)

(73) Assignee: Malibu Lighting Corporation, Dallas, TX (US)

( * ) Notice: Subject to any disclaimer, the term of this patent is extended or adjusted under 35 U.S.C. 154(b) by 366 days.

(21) Appl. No.: 11/650,606

(22) Filed: Jan. 5, 2007

(65) Prior Publication Data

US 2008/0166930 A1 Jul. 10, 2008

(51) Int. Cl.
*H01R 4/36* (2006.01)

(52) U.S. Cl. ..... 439/813; 336/92; 361/38

(58) Field of Classification Search ..... 439/793, 439/778, 779, 780, 810–813; 361/38; 336/92
See application file for complete search history.

(56) References Cited

U.S. PATENT DOCUMENTS 1,677,783 A 7/1928 Kearney
2,597,037 A 5/1952 Runde
2,740,100 A 3/1956 Broverman
3,052,866 A * 9/1962 Koch ..... 439/727
3,552,257 A 1/1971 Tanabe
3,588,790 A 6/1971 Shannon
3,673,550 A 6/1972 Sherman
3,923,406 A 12/1975 Iritz
3,979,707 A * 9/1976 Prince, Jr. ..... 336/107
4,365,861 A 12/1982 Gore
4,427,252 A 1/1984 Lee et al.
5,083,930 A 1/1992 Barron
5,086,379 A 2/1992 Denison et al.
5,129,844 A 7/1992 Goto et al.
5,167,526 A 12/1992 Pinyan et al.
5,226,841 A 7/1993 Thörner
5,310,365 A 5/1994 Hashimoto
5,380,227 A 1/1995 Taylor
5,616,433 A 4/1997 Kau

* cited by examiner

*Primary Examiner*—Ross N Gushi
(74) *Attorney, Agent, or Firm*—Sheppard, Mullin, Richter & Hampton LLP

(57) ABSTRACT

A device is disclosed for connecting electrical devices. The device may include a transformer, a connector post with a nut, and a conductor. The conductor may be positioned from the transformer to an opening of the connector post. The conductor may be a metal plate. The nut may clamp the device lead to the conductor to electrically connect them. The nut may be retained on the post, even when unsecured from the post.

4 Claims, 6 Drawing Sheets

ELECTRICAL CONNECTOR

BACKGROUND

Electrical connectors are often used for connecting electrical devices to electrical equipment. In some cases, the electrical device is a transformer. Transformers are often the power packs for the electrical equipment such as, for example, outdoor low voltage landscape lighting. Such equipment may be provided for sale and installation by the general consumer.

A typical transformer may include primary and secondary windings. Power travels from the secondary windings through an extension of the windings, typically a stranded wire, where it is connected to a wire from the electrical equipment. The wires from the electrical device and the transformer may be held together by, among other means, inserting them between two washers and securing them with a screw. If the wire that connects the transformer to the terminal is not sufficiently secure, electrical heating can occur.

BRIEF SUMMARY

An electrical connector for connecting electrical devices is disclosed having a combination of posts, a retained nut, and a conductor plate. The posts may be threaded and may have an internal channel. The internal channel may contain the conductor plate and may position the conductor to deliver electrical power to a wire from a power supply. The nut may be associated with the connector post by internal threading. The nut may also be retained on the post, when unsecured from the post, by a retaining piece. The retaining piece may be on the post, on the nut, or on both the nut and the post.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

An electrical connector is described for making an electrical connection between an electrical device, such as a transformer, and a wire supplying power to a load, such as low voltage lights. The connection may be made without the use of tools, such as by using a bolt or post and a nut. A lead from the transformer to the post may be a conductor plate or metal stamping. A connection may be made between a lead of the load and the conductor plate by placing the load lead through an opening of the post. The load lead may be secured by adjusting the tightening nut, such that the nut may exert a clamping force on the load lead and/or conductor plate, electrically connecting them. When unsecured, the tightening nut may be retained on the post portion of the terminal.

Such terminals may be used, for example, for coupling lines to electrical devices from power transformers. Connecting and disconnecting the leads may be easily carried out by hand and without tools, since consumers may prefer devices that are simple to install, for example, require fewer steps, less maintenance, and fewer tools.

Figure 1:
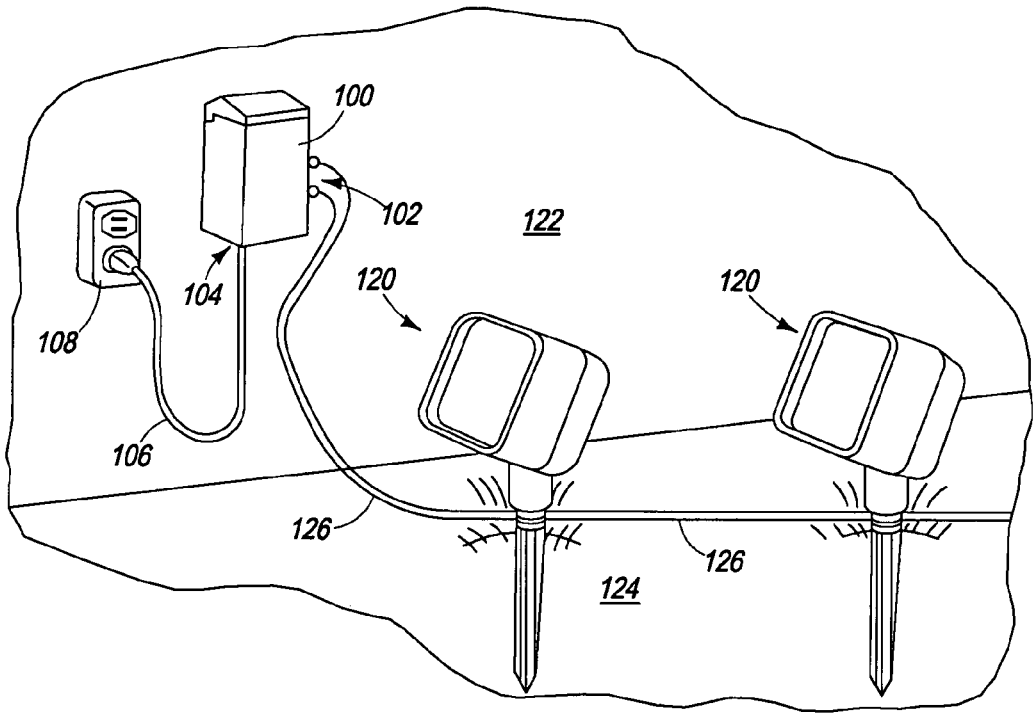
FIG. 1 is a plan view of a transformer connector in an environment connected to two lights.

FIG. 1 is a plan view of an electrical connector device ("device") 100 in one possible environment of use. The device 100 may be wall 122 mounted, or it may be mounted in any other way, including on a post, or on the power source 108. Alternatively and/or additionally, the device 100 may rest on the ground 124. The device may be connected to a load 120, for example, lights. The connection to the device 100 from the load 120 may be by a device lead such as a wire 126. The device lead 126 from the load 120 may connect to the device 100 at a connector post or "terminal" 102. A power line 106 may connect the device 100 to the power source 108, such as a wall receptacle. Alternatively and/or additionally, the device 100 may be connected to the power source 108 directly, such as by a two prong, three prong, GFCI or other connectors.

Figure 2:
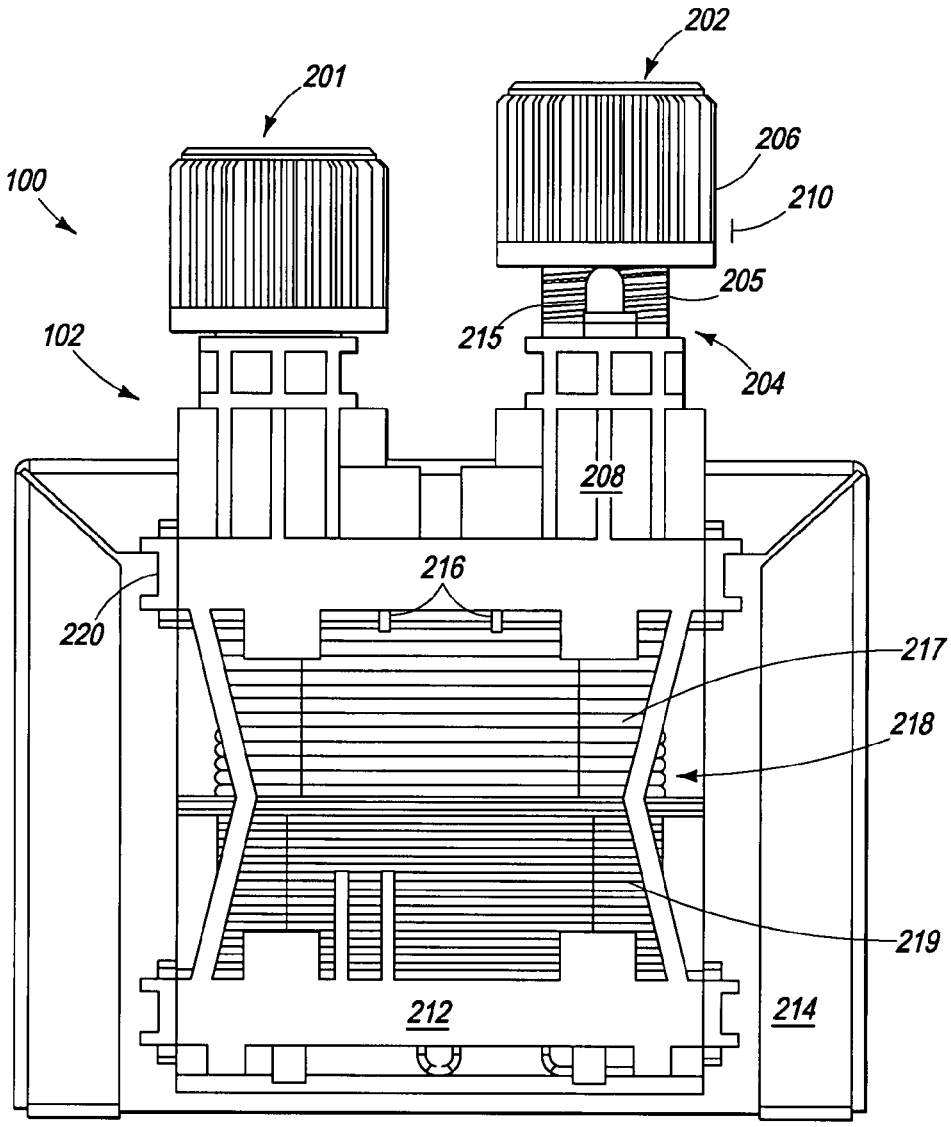
FIG. 2 side cutaway view of a bolt and nut assembled with a transformer.

FIG. 2 is side-view in cross section of the device 100. The device 100 may include a first post terminal 201 and a second post terminal 202. Each post terminal (e.g., 201, 202) may have a post 204 and a securing device such as a nut 206.

The nut 206 may be manufactured from, for example, plastic and/or plastic with a metal insert. The nut 206 may be mounted to rotate via a thread 205 on the post 204. The nut 206 may be secured to the post 204 as in 201. Alternatively and/or additionally, when the nut 206 is unsecured from the post 204, the nut 206 may be retained on the post 204 as in 202.

The outer surface of the nut 206 may be textured to be easily gripped, such as, the outer surface may be scored, grooved or otherwise textured. This may provide a friction surface to assist a user to twist the nut to connect a load to a device 100 without the use of tools.

Portions of the post 204 may be manufactured from a conductive or non-conductive material such as plastic. The post 204 may have a first side 208 which may be proximate to a transformer 218 and a second side 210 which is distal to a transformer 218. The transformer 218 may have a primary 219 and a secondary 217 winding. The device 100 may be used with step-up and/or step-down transformers, such as a 10 to 1 step-down transformer to convert a 120V power supply to 12V, such as for low voltage lighting. The device 100 and/or transformer 218 may also be used with other loads and for other step-up or step-down ratios.

An opening 215 may be defined, such as transversely, through the post 206. The opening 215 may be sized to accept a wire from the load 120. The opening 215 may be situated such that a device lead 126 from the load 120 may form an electrical connection with a conductor 216. The conductor 216 is positioned between the opening 215 from the transformer 218.

The terminal 102, including the first 201 and second 202 post terminals, may be situated in a terminal housing 212. The transformer 218 may be situated in a transformer housing 214. The terminal housing 212 and the transformer housing 214 may be independent and separable or manufactured as a unitary housing. If separable, the terminal housing 212 and transformer housing 214 may be keyed, for example, with projections 220 and receiving channels which may facilitate assembly of the terminal housing 212 with the transformer housing 214.

Figure 3:
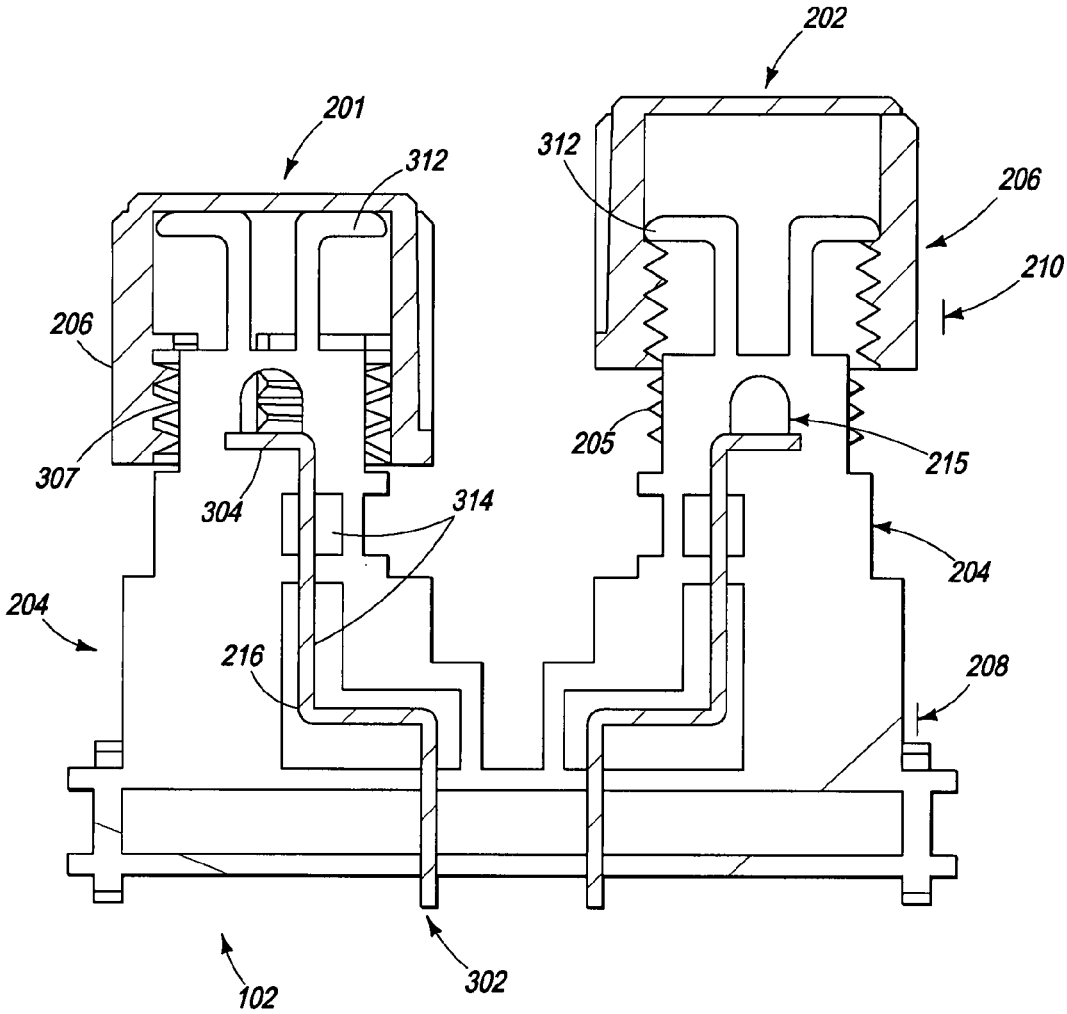
FIG. 3 is a side view of a cross-section of a post and nut assembled with a conductor plate.

FIG. 3 is a cross section of the terminal 102 of the device 100. Each post terminal (e.g., 201, 202) may have a post 204 and a nut 206. The nut 206 may be secured to the post section 204 as in fixed position 201. (See FIG. 5). When the nut 206 is not secured to the post 204, the nut 206 may be retained on the post section 204 by a retaining piece 312, as in unsecured position 202. (See FIG. 4).

A first side 208 and a second side 210 of the post 204 are shown. The second side 210 of the post 204 may terminate in the retaining piece 312. The retaining piece 312 may extend upward from the post 204 to form an inverted L-shape. The retaining piece 312 may contact the nut 206 to prevent it from being released from the post 204 when in the unsecured position 202.

The post 204 may have an opening or series of openings which may define a path or channel 314 for the conductor 216. At one end the conductor 216 may electrically connect to windings of the transformer 218 and the other end may terminate at or near the post 204 to connect with an electrical line positioned with the post 204. The opening or series of openings 314 may terminate in an opening 215 which may be defined in the post 204. The opening 215 may accept the device lead from the load 120. The opening 215 may be situated such that the device lead from the load may form an electrical connection with a conductor 216 from a transformer.

The conductor 216 from a transformer 218 may be a traditional solid or stranded wire. Alternatively or additionally, the conductor 216 may be a plate or metal stamping which may have a first side 302 and a second side 304. The plate may be fashioned from any conductive material such as a conductive metal. A plate conductor 216 may be sturdier than a traditional stranded wire, which may increase the life of the connection. Additionally, the plate may increase the life of the transformer because it may be easier to replace than a stranded wire.

Use of a plate conductor 216 may simplify assembly of the electrical interconnection. The first side 302 of the conductor 216 may be so dimensioned to form a connection with a device lead 126 from the load 120. The second side 304 of the conductor 216 may form a connection with the transformer 218. The conductor 216 may reside in a channel 314 defined in a post 204. The conductor 216 may interconnect with an electrical device wire at a distal opening 215 in the post. The conductor 216 and the device lead 126 may be interconnected by pressure exerted on them by the nut 206 when the nut is secured to the post 204 as in position 201.

The nut 206 may be mounted to rotate via a thread 205 on the post 204. The nut 206 may have an internal thread 307 which may engage the external thread 205 on the post 204 during securing.

Figure 4:
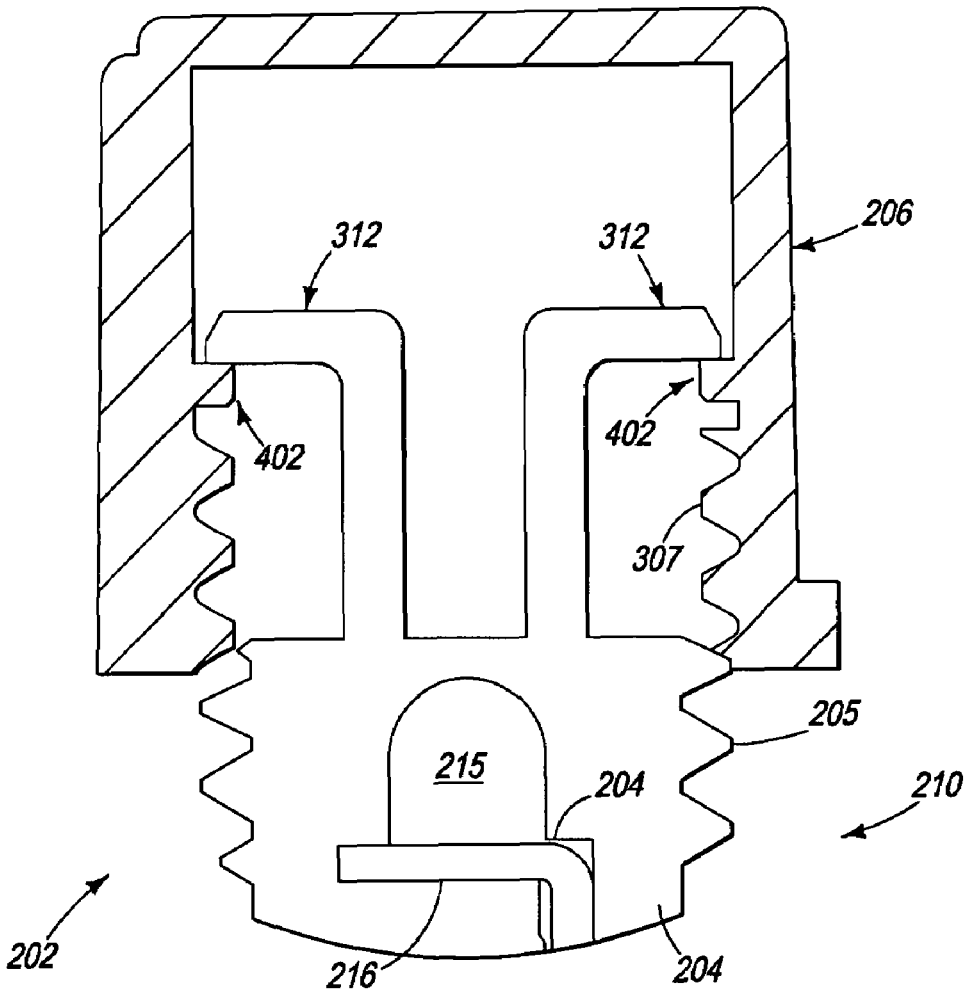
FIG. 4 is a side view of a cross-section of a post and unsecured nut.

FIG. 4 is a close up, cross-section view of a nut 206, the distal end 210 of a post 204, and a conductor plate 216. The nut 206 may have an inner lip 402 which may be located above the inner nut threads 307. The nut 206 is unsecured but retained on the post 204 by a retaining piece 312. The retaining piece 312 may stop the nut 206 from coming completely off of the post 204 by engaging the lip 402.

Figure 5:
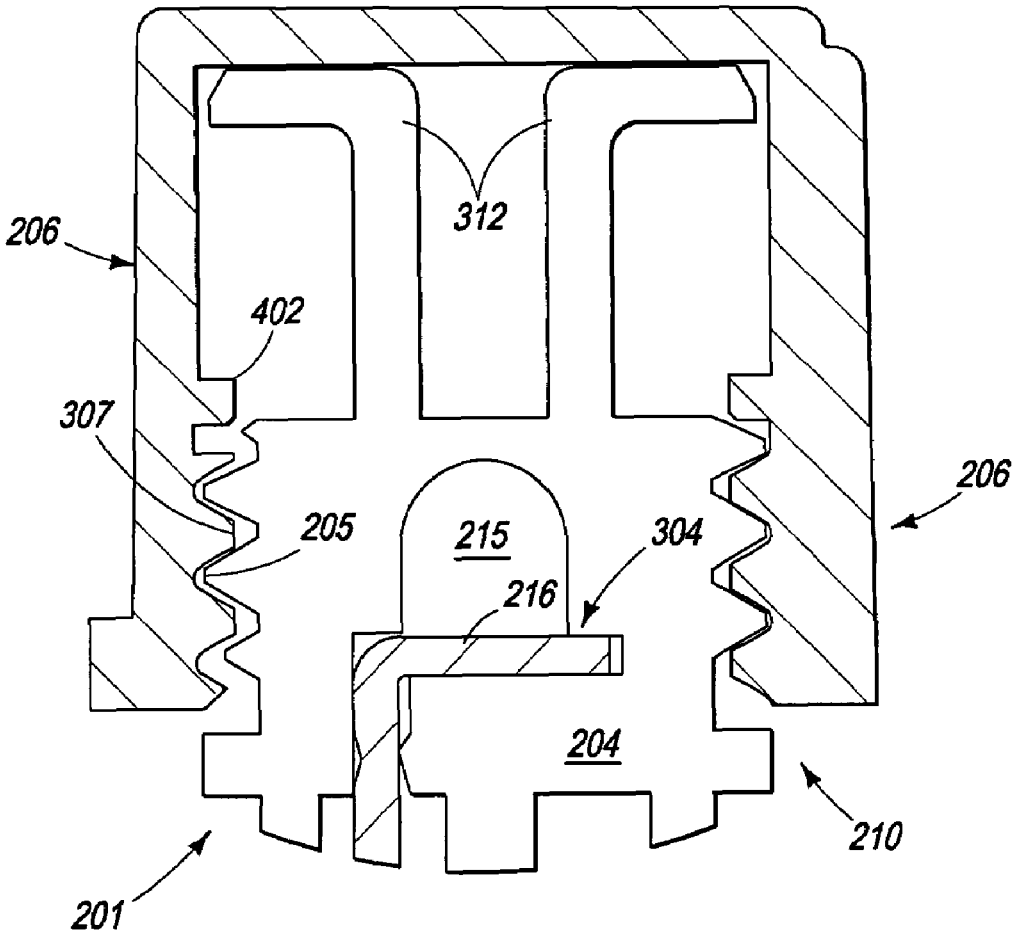
FIG. 5 is a side view of a cross-section of a post and secured nut.

FIG. 5 is a close up, cross-section view of a nut 206 secured to the distal end 210 of a post 204, for example, by engagement of the nut threads 307 with the post threads 205. When the nut 206 is secured to the post 204 the inner lip 402 may be located suspended above or flush with the engaged nut threads 307 and post threads 205. A lead from a load may be introduced into the opening in the post 215 such that when the nut 206 is secured to the post 204 the lead comes to rest securely against the conductor 216 forming a tight electrical interconnection.

Figure 6:
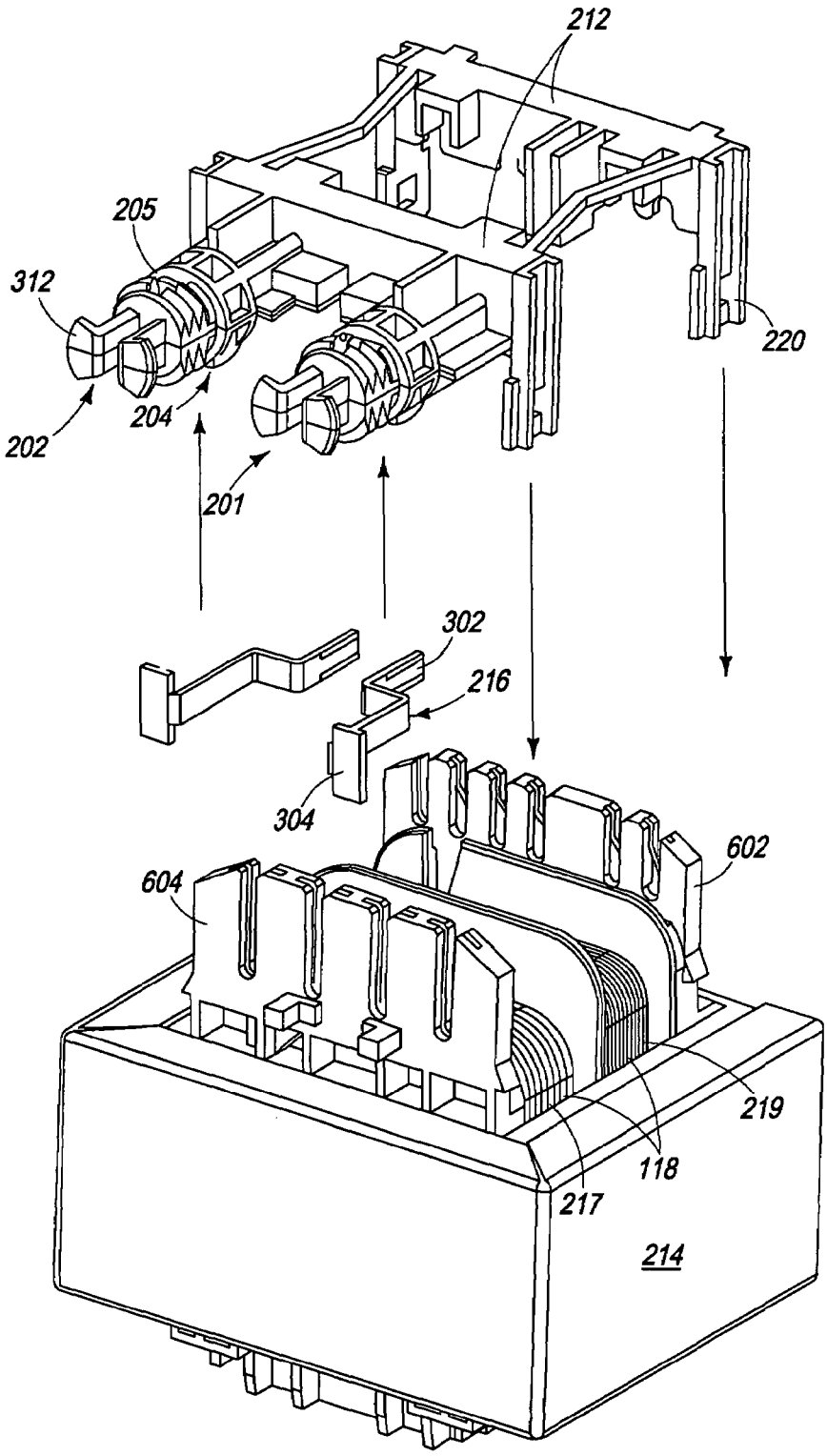
FIG. 6 is a perspective view illustrating one assembly of the post and nut assembly with connector plates and a transformer.

FIG. 6 is a perspective view of the transformer 218 and transformer housing 214 unassembled from the terminal 102 and terminal housing 212. If the terminal 102 and terminal housing 212 are detachable, it may simplify replacement of the transformer conductor 216.

The transformer housing 214 may have portions (e.g., 602, 604) which are keyed to fit to the terminal housing 212. For example, the transformer housing 214 may have a first piece 602 and a second piece 604. The first piece 602 and second piece 604 may have one or more projections. The first piece 602 may differ from the second piece, for example, the second piece 604 may contain receiving channels adapted for securing a conductor 216 such that it may transfer an electric field to and from an electrical device. The receiving channels or projections may further be adapted to receive the terminal 102 and terminal housing 212.

The terminal housing 212 may also be keyed with projections, spaces or fingers which may be adapted to receive a conductor 216, transformer 218, or transformer housing 214. The pattern of projections, spaces or fingers may differ between the first piece 602 and the second piece 604 and may facilitate proper assembly by deterring misalignment of the terminals 102 and the transformer 218.

The device 100 may be assembled by inserting the conductor 216 into the channel (FIG. 3, 314) of the post 204. The connectors 201, 202 may be pressed into the transformer 218 and transformer housing 214 and secured by the complementary keying discussed above. The entire device 100 may include the connectors 201 and 202 and the transformer 218 and may be assembled by hand and may not require tools or peripheral securing devices such as screws. Tool-less assembly may permit an installer to easily connect a cable from an electrical device to a transformer or power pack without any danger of the connector parts, such as the nut 206, post 204, and conductor 216 becoming disassembled or completely disconnected.

While various embodiments of the invention have been described, it will be apparent to those of ordinary skill in the art that many more embodiments and implementations are possible that are within the scope of the invention.

I claim:

1. A device for connecting electrical devices, the device comprising:

a transformer;

a connector post, the connector post defining an opening;

a conductor positioned from the transformer to the opening of the connector post;

a nut associated with the connector post, wherein the nut can freely rotate about the post, and wherein the nut is retained when unsecured from the post by a retaining piece on the post, nut or both;

a transformer housing and a connector post housing, wherein the transformer and the connector post are housed separately, and wherein the transformer housing and connector post housing are complementarily keyed to fit together in only one direction.

2. The device of claim 1, wherein assembly of the transformer housing and connector post housing is accomplished without the use of tools.

3. A device for connecting electrical devices, the device comprising:

a housing;

a transformer positioned in the housing;

a connector post having a channel defined through the connector post; and a conductor plate electrically connecting the transformer to the internal channel of the connector post;

wherein the housing comprises more than one unit;

wherein the housing comprises a transformer housing and a connector post housing; and wherein the transformer housing and the connector post housing are complementarily keyed to fit together in only one direction.

4. The device of claim 3, wherein assembly of the transformer housing and connector post housing is accomplished without the use of tools.

* * * * *